US010754293B1

(12) United States Patent
Izumi

(10) Patent No.: US 10,754,293 B1
(45) Date of Patent: Aug. 25, 2020

(54) IMAGE FORMING APPARATUS HAVING HEATER, TEMPERATURE SENSOR AND CONTROLLER WHICH DISABLES PRINT SUSPEND OPERATION

(71) Applicant: TOSHIBA TEC KABUSHIKI KAISHA, Tokyo (JP)

(72) Inventor: Takao Izumi, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/567,719

(22) Filed: Sep. 11, 2019

(51) Int. Cl.
*G03G 21/00* (2006.01)
*G03G 21/20* (2006.01)
*G03G 15/00* (2006.01)

(52) U.S. Cl.
CPC ..... *G03G 21/20* (2013.01); *G03G 15/5004* (2013.01)

(58) Field of Classification Search
CPC ..... G03G 15/5004; G03G 15/5045; G03G 21/20; G03G 2215/00084
USPC ..... 399/44, 88, 94, 96
See application file for complete search history.

(56) References Cited

U.S. PATENT DOCUMENTS 9,335,732 B2 * 5/2016 Nishi ..... G03G 15/5004
9,531,898 B2 * 12/2016 Nakamura ..... H04N 1/00891
2003/0111218 A1 * 6/2003 Iguchi ..... H04N 1/00127 165/200
2008/0002999 A1 * 1/2008 Taki ..... G03G 15/6502 399/44
2008/0025751 A1 * 1/2008 Andoh ..... G03G 15/5004 399/94
2013/0318382 A1 * 11/2013 Yoshihara ..... G06F 1/3284 713/323
2014/0064756 A1 3/2014 Sugiyama et al.
2017/0257511 A1 * 9/2017 Matsui ..... G03G 15/50
2019/0129358 A1 * 5/2019 Hasegawa ..... G03G 15/5016

* cited by examiner

*Primary Examiner* — Robert B Beatty
(74) *Attorney, Agent, or Firm* — Kim & Stewart LLP

(57) ABSTRACT

An image forming apparatus includes an image forming unit, a temperature sensor configured to measure a temperature of the image forming unit, and a controller. The controller is configured to control an operational state of the image forming apparatus to be in a print ready state or a print unready state in which power consumption of the image forming apparatus is less than power consumption of the image forming apparatus in the print ready state. For a preset period after the image forming apparatus transitions out of the print unready state, the controller disables a print suspend operation that is otherwise carried out when the temperature detected by the temperature sensor is a threshold value or higher. After the preset period, the controller enables the print suspend operation.

20 Claims, 5 Drawing Sheets

IMAGE FORMING APPARATUS HAVING HEATER, TEMPERATURE SENSOR AND CONTROLLER WHICH DISABLES PRINT SUSPEND OPERATION

FIELD

Embodiments described herein relate generally to an image forming apparatus and a print control method.

BACKGROUND

In the related art, when continuous printing is being performed in an image forming apparatus, the temperature around an image forming unit may be excessively increased. In such a case, the image forming apparatus may temporarily interrupt the image forming processes until the temperature drops back below some upper threshold temperature. On the other hand, in order to prevent condensation of humidity inside the image forming unit, the image forming apparatus attempts to keep the image forming unit above some predetermined temperature using a anti-humidity heater when the temperature drops too far. However, when the image forming apparatus includes a anti-humidity heater, image forming operations may sometimes be unintentionally interrupted due to the heat generated by operations of the anti-humidity heater. As a result, printer performance may be degraded.

DETAILED DESCRIPTION

In general, according to an embodiment, an image forming apparatus includes an image forming unit, a temperature sensor configured to measure a temperature of the image forming unit, and a controller. The controller is configured to control an operational state of the image forming apparatus to be in a print ready state or a print unready state in which power consumption of the image forming apparatus is less than power consumption of the image forming apparatus in the print ready state. For a preset period after a timer at which the image forming apparatus transitions out of the print unready state, the controller disables a print suspend operation which is carried out when the temperature detected by the temperature sensor is a threshold value or higher. After the preset period elapses, the controller enables the print suspend operation.

Hereinafter, examples of an image forming apparatus and a print control method of embodiments will be described with reference to the drawings.

Figure 1:
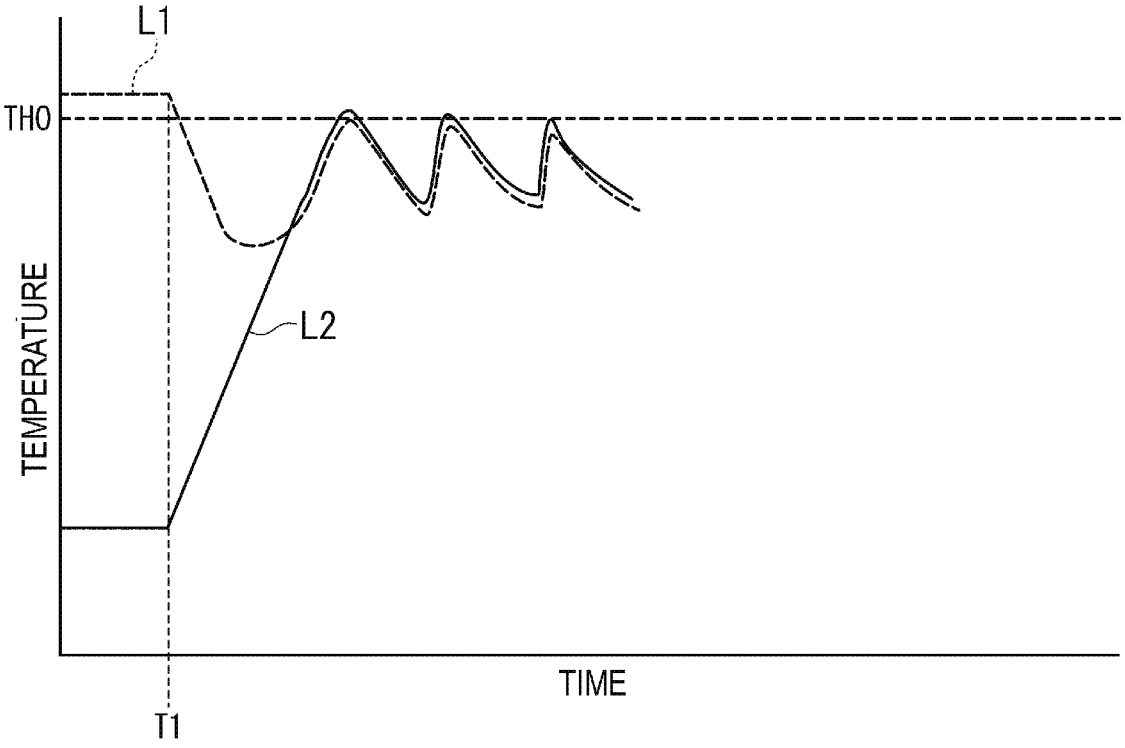
FIG. 1 is a diagram for illustrating aspects of temperature changes in an image forming apparatus.

FIG. 1 is a diagram illustrating a temperature profile in an image forming apparatus over time. An image forming apparatus in an embodiment includes a anti-humidity heater and operates to maintain the inside of the machine to be a certain temperature or higher. In FIG. 1, the horizontal axis represents time, and the vertical axis represents temperature inside the machine. The temperature inside the machine is, for example, the temperature according to a drum thermistor within the machine. In FIG. 1, the temperature TH0 represents the upper limit temperature, and the time T1 represents the time when printing was started. In general, it is desirable for the image forming apparatus to perform printing without exceeding the upper limit temperature TH0. When the upper limit temperature TH0 is exceeded, printing operations may be stopped.

A transition line L1 represents the temperature transition when heating is performed by the anti-humidity heater during the pause state (time before time T1). In the example illustrated in FIG. 1, the temperature inside the machine already exceeds the upper limit temperature TH0 before printing has even started due to heating by the anti-humidity heater. When printing is started in this state, the image forming apparatus stops or delays image forming operations although the image forming unit is otherwise in a ready state and printing is possible. As a result, performance of the apparatus is reduced, more specifically the number of sheets that can be processed per unit time is reduced.

A transition line L2 represents the temperature transition when there is no heating by the anti-humidity heater during the pause state. Since there is no heating by the anti-humidity heater, the temperature inside the machine body is low before printing starts. When printing is started in this state, the image forming apparatus begins executing the image forming operations immediately.

As illustrated in FIG. 1, in a case where there is heating by the anti-humidity heater during the pause state, the image forming operation may be delayed.

Considering the points described above, the image forming apparatus in the present embodiment continues or starts a printing operation regardless of the temperature inside the machine during a predetermined period after transitioning from the pause state. With this configuration, the image forming apparatus in the present embodiment prevents interruption of the image forming operations because of heat from the anti-humidity heater.

Figure 2:
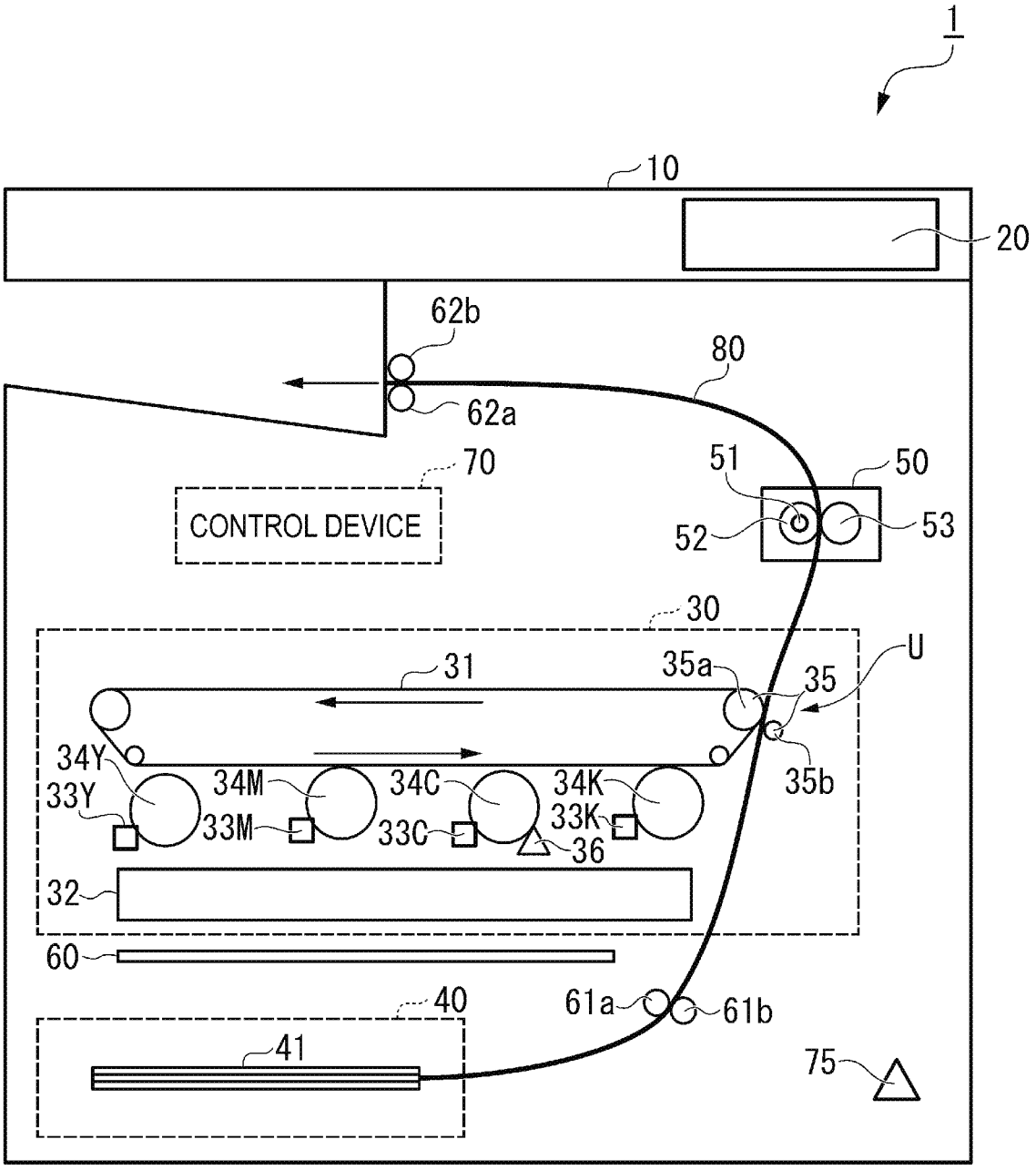
FIG. 2 depicts aspects of an image forming apparatus according to an embodiment.

FIG. 2 is a schematic diagram illustrating an example of an overall configuration of the image forming apparatus according to an embodiment. An image forming apparatus 1 of the present embodiment is a multifunction peripheral (MFP). The image forming apparatus 1 executes printing by an image forming process and an image fixing process. The image forming process is a process of forming an image on a sheet. The image fixing process is a process of fixing the image formed on the sheet to the sheet. The sheet is, for example, a sheet of paper on which characters, images, and the like can be formed. In general, in this context, the sheet may be anything as long as the image forming apparatus 1 process it. The image forming apparatus 1 can read an image appearing on a sheet or a document and generate digital data or an image file.

The image forming apparatus 1 includes an image reading unit 10, a control panel 20, an image forming unit 30, a sheet accommodating unit 40, a fixing device 50, a anti-humidity heater 60, conveyance rollers 61*a* and 61*b*, paper discharge rollers 62*a* and 62*b*, a control device 70, and a first temperature sensor 75.

The image reading unit 10 reads images on sheets/documents using reflected light values. For example, the image reading unit 10 reads an image printed on a sheet when the sheet is placed on an original document reading platen. The image reading unit 10 records the image information that is read. The recorded image information may be transmitted to another information processing device via a network. The recorded image information may also be used to form an image on a sheet using the image forming unit 30.

The control panel 20 includes a display unit and an input unit. The display unit is a display device such as a liquid crystal display and an organic electroluminescence (EL) display. The display unit displays various pieces of information relating to the image forming apparatus 1 according to control of the control device 70. The input unit includes a plurality of buttons and the like. The input unit receives an input operation from a user. The input unit sends a signal corresponding to the input operation(s) performed by the user to the control device 70. The display unit and the input unit may be configured as an integrated touch panel.

The image forming unit 30 executes an image forming process. Specifically, the image forming unit 30 forms an image on a sheet based on image information generated by the image reading unit 10 or else image information received via a communication path. For example, the image forming unit 30 forms a toner image on a sheet with toner.

The image forming unit 30 includes a transfer belt 31, an exposure unit 32, a plurality of developing devices (developing devices 33Y, 33M, 33C, and 33K), a plurality of photoconductive drums (photoconductive drums 34Y, 34M, 34C, and 33K), a transfer unit 35, and a second temperature sensor 36.

Here, the transfer belt 31 is an intermediate transfer belt. The transfer belt 31 rotates in the direction (counterclockwise) indicated by the arrows by rotation of rollers. The transfer belt 31 comprises, for example, a semiconductive polyimide for heat resistance and abrasion resistance.

An exposure unit 32 is provided at a position facing the photoconductive drums 34Y, 34M, 34C, and 34K of the developing devices 33Y, 33M, 33C, and 33K. The exposure unit 32 irradiates a surface (including a photosensitive material layer) of each of the photoconductive drums 34Y, 34M, 34C, and 34K with a laser beam based on the image information.

Negative charges on the photosensitive material layer of each of the photoconductive drums 34Y, 34M, 34C and 34K dissipates with irradiation by the laser beam. As a result, an electrostatic pattern is formed on the surface of the photoconductive drums 34Y, 34M, 34C, and 34K corresponding to the positions irradiated with the laser beam. That is, by irradiation of laser beam from the exposure unit 32, electrostatic latent images are formed on the surfaces of the photoconductive drums 34Y, 34M, 34C, and 34K. The exposure unit 32 may use light emitting diode (LED) light instead of laser beam. Light emission of the exposure unit 32 is controlled based on the image information under control of the control device 70.

The developing devices 33Y, 33M, 33C and 33K supply toner to the photoconductive drums 34Y, 34M, 34C and 34K, respectively. For example, the developing device 33Y develops the electrostatic latent image on the surface of the photoconductive drum 34Y with yellow (Y) toner. The developing device 33M develops the electrostatic latent image on the surface of the photoconductive drum 34M with magenta (M) toner. The developing unit 33C develops the electrostatic latent image on the surface of the photoconductive drum 34C with cyan (C) toner. The developing device 33K develops the electrostatic latent image on the surface of the photoconductive drum 34K with black (K) toner.

The developing devices 33Y, 33M, 33C and 33K form a toner image as a visible image on the photoconductive drums 34Y, 34M, 34C and 34K, respectively. The toner images formed on the photoconductive drums 34Y, 34M, 34C and 34K are transferred (primary transfer) to the transfer belt 31.

The transfer unit 35 includes a support roller 35*a* and a secondary transfer roller 35*b*. The transfer unit 35 transfers the toner image on the transfer belt 31 to a sheet 41 at a secondary transfer position U. The secondary transfer position U is a position at which the support roller 35*a* and the secondary transfer roller 35*b* face each other with the transfer belt 31 therebetween. The transfer unit 35 applies a transfer bias controlled by a transfer current to the transfer belt 31. The transfer unit 35 transfers the toner image on the transfer belt 31 to the sheet 41 by the transfer bias. The transfer current is controlled by the control device 70.

The second temperature sensor 36 is a temperature measurement unit that measures a temperature of the image forming unit 30 or near the image forming unit 30. For example, the second temperature sensor 36 measures the temperature of the photoconductive drum 34C. The second temperature sensor 36 is, for example, a drum thermistor. The second temperature sensor 36 is installed near the photoconductive drum 34C. The second temperature sensor 36 may instead be installed near any of the other photoconductive drums 34Y, 34M and 34K. The second temperature sensor 36 transmits a measurement result corresponding to the temperature to the control device 70 either periodically or at a fixed time or upon request. The fixed time may be, for example, a preset time or may be a time at which a request for the measurement result is made by the control device 70. In the following description, the measurement result corresponding to the temperature as measured by the second temperature sensor 36 is referred to as a second temperature t2.

A sheet accommodating unit 40 includes one or more paper feed cassettes. The paper feed cassette stores the sheets 41 of a predetermined size and a predetermined type. The paper feed cassette includes a pickup roller. The pickup roller takes out the sheets 41 one by one from the paper feed cassette. The pickup roller supplies a picked up sheet 41 to a conveyance unit 80.

The fixing device 50 executes the image fixing process. Specifically, the fixing device 50 heats and presses each sheet 41 to fix the image (for example, a toner image) previously formed on the sheet 41 to the sheet 41. The fixing device 50 includes a heat source 51, a heat roller 52, and a pressure roller 53. The heat source 51 is a heater lamp such as a halogen lamp or a heater using an induction heating (IH) method. The heat source 51 is turned on or off according to the presence or absence of power controlled by the control device 70. The heat roller 52 is warmed by heat generated when the heat source 51 is energized. The heat roller 52 applies heat to the sheet 41. The pressure roller 53 is disposed to face the heat roller 52. The pressure roller 53 presses the sheet 41 against the heat roller 52. The fixing device 50 includes a temperature sensor (not separately illustrated). This temperature sensor measures the temperature of the heat roller 52 and transmits the measured temperature of the heat roller 52 to the control device 70.

The anti-humidity heater 60 heats the inside of the image forming apparatus 1. The anti-humidity heater 60 is provided, for example, under the image forming unit 30. The anti-humidity heater 60 is a heating unit that heats the inside of the image forming apparatus 1 so that the temperature in the image forming unit 30 is maintained at or above a predetermined temperature (for example, 25° C. or higher). The anti-humidity heater 60 includes a heater and a thermostat.

The heater of the anti-humidity heater 60 includes, for example, a plurality of heat generating elements within the image forming apparatus, and the inside of the image forming apparatus 1 is heated by heat from the heat generating elements. The heating is switched on and off by the thermostat. When the heater is switched on by the thermostat, power is supplied to the heater. On the other hand, when the heater is switched off by the thermostat, no power is supplied to the heater. The thermostat switches the on and off states of the heater. Power is supplied to the heater by operation of a mechanical switching connection between the thermostat and the heater. On the other hand, power to the heater is cut off by opening the mechanical switching connection between the thermostat and the heater.

The connection and disconnection between the thermostat and the heater is based on the temperature measured by the first temperature sensor 75. The first temperature sensor 75 is an outside air temperature measurement unit. For example, when the temperature measured by the first temperature sensor 75 is equal to or higher than a stop temperature, the thermostat is disconnected from the heater. The stop temperature is, for example, 29° C. When the temperature measured by the first temperature sensor 75 is equal to or lower than a heat generation temperature, the thermostat is connected to the heater and the heater generates heat. The heat generation temperature is, for example, 20° C. When the temperature in the image forming apparatus 1 is equal to or lower than the heat generation temperature, the thermostat raises the temperature in the image forming apparatus 1 even in the pause state.

As described above, when the temperature measured by the first temperature sensor 75 is equal to or lower than the heat generation temperature, the thermostat puts the heater in the on state to raise the temperature in the image forming apparatus 1. As a result, the temperature of the image forming unit 30 is maintained at a certain temperature or higher. In contrast, when the temperature measured by the first temperature sensor 75 is equal to or higher than the stop temperature, the thermostat puts the heater in the off state. With this configuration, the temperature in the image forming apparatus 1 is not unnecessarily increased.

The conveyance rollers 61*a* and 61*b* supply the sheet 41 fed from the paper feed cassette to the image forming unit 30. The conveyance rollers 61*a* and 61*b* face each other.

The paper discharge rollers 62*a* and 62*b* discharge the sheet 41 on which the image is formed by the fixing device 50 to a paper discharge unit. The paper discharge rollers 62*a* and 62*b* face each other.

The control device 70 controls each functional unit of the image forming apparatus 1.

The first temperature sensor 75 is a sensor that measures the temperature outside the image forming apparatus 1. The first temperature sensor 75 is installed at a position away from the image forming unit 30. The position away from the image forming unit 30 is, for example, a position around an exhaust port of the image forming apparatus 1. The first temperature sensor 75 transmits the measurement result corresponding to the temperature to the anti-humidity heater 60 and the control device 70 periodically, a fixed time, or upon request from the control device 70. In the following description, the measurement result of the temperature measured by the first temperature sensor 75 is referred to as a first temperature t1.

The conveyance unit 80 conveys the sheet 41. The conveyance unit 80 includes a conveyance path and a plurality of rollers. The conveyance path is a path along which the sheet 41 is conveyed. The roller conveys the sheet 41 by rotating according to control of the control device 70.

Figure 3:
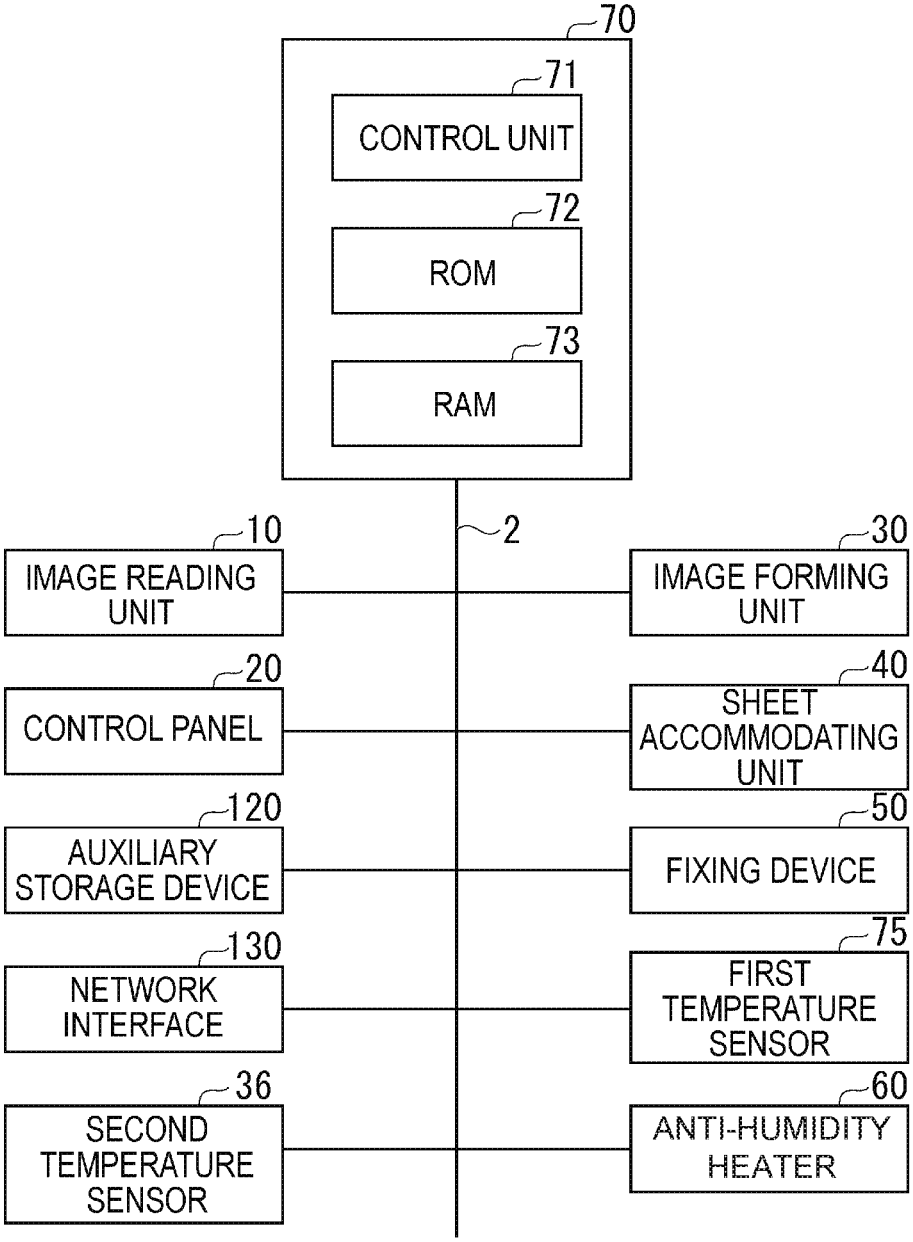
FIG. 3 is a block diagram illustrating a hardware configuration of an image forming apparatus.

FIG. 3 is a block diagram illustrating a hardware configuration of the image forming apparatus 1 of an embodiment. FIG. 3, is schematic and only a general hardware configuration of an image forming apparatus 1 is illustrated.

The image forming apparatus 1 includes the image reading unit 10, the control panel 20, the image forming unit 30, the second temperature sensor 36, the sheet accommodating unit 40, the fixing device 50, the anti-humidity heater 60, the control device 70, the first temperature sensor 75, an auxiliary storage device 120, and a network interface 130. Each functional unit is connected so as to be capable of data communication via a system bus 2.

The description on the image reading unit 10, the control panel 20, the image forming unit 30, the second temperature sensor 36, the sheet accommodating unit 40, the fixing device 50, the anti-humidity heater 60, and the first temperature sensor 75 has been made as above, and thus the description there of is omitted. In the following, the control device 70, the auxiliary storage device 120, and the network interface 130 will be described.

The control device 70 includes a control unit 71, a read only memory (ROM) 72, and a random access memory (RAM) 73. The control unit 71 is, for example, a processor such as a central processing unit (CPU) or a graphics processing unit (GPU). The control unit 71 controls the operation of each functional unit of the image forming apparatus 1. The control unit 71 executes various processes by loading a program stored in the ROM 72 onto the RAM 73 and executing the program. In other examples, an application specific integrated circuit (ASIC) may be utilized to provide a function performed by the control unit 71. An ASIC is a dedicated circuit for implementing a specific function.

Next, a specific operation of the control unit 71 will be described.

When printing has not been performed for a certain period, the control unit 71 shifts a state of the image forming apparatus 1 from a ready state to a pause state. The ready state is a state in which the image forming apparatus 1 can start printing. The pause state is a power saving state in which supply of power to the image forming unit 30 is stopped and unready. In some contexts, the pause state may be referred to as a sleep state, a power saving mode, a power reduction mode, or a power reduction state. In the power saving state, power consumption is less than that in the ready state and only some processes (functions) of the image forming apparatus 1 are possible. A specific process available in the power saving state is, for example, communication with a client device or reception of a print job instruction. When an instruction to execute printing is received during the pause state, the control unit 71 shifts the state of the image forming apparatus 1 from the pause state to the ready state.

The control unit 71 causes the image forming unit 30 to execute image formation until some preset period has elapsed after a time after the instruction to return from the pause state is received. The control unit 71 causes the image forming unit 30 to execute image formation even if the second temperature t2 is equal to or higher than a threshold value until the preset period has run from some point in time after the instruction to return from the pause state. For example, any of the following (1) to (4) points in time may be utilized as a starting point for the preset period. The control unit 71 determines whether or not the image forming apparatus has returned from the pause state according to, for example, one of the following times:

(1) The time when the image forming apparatus comes out of the pause state (2) The time when heating by the anti-humidity heater 60 is stopped (3) The time when the image forming apparatus 1 enters the ready state (4) The time when the image forming apparatus 1 actually starts the printing operation The preset period can be a time period (for example, 20 minutes, 1 hour, and the like) determined in advance or a period until a predetermined number of sheets (for example, 10 sheets, 100 sheets, and the like) are printed.

When the second temperature t2 is equal to or higher than the threshold value after the preset period has elapsed, the control unit 71 stops formation of the image by the image forming unit 30 for a predetermined time (for example, 2 minutes). Then, the control unit 71 causes the image forming unit 30 to execute formation of the image after the predetermined time has elapsed and performs printing for a predetermined number of sheets (for example, 200 sheets).

The ROM 72 stores a program for operating the control unit 71. The RAM 73 temporarily stores data used by each functional unit included in the image forming apparatus 1. For example, the RAM 73 stores the measurement result (first temperature t1) from the first temperature sensor 75 and the measurement result (second temperature t2) from the second temperature sensor 36. The RAM 73 may store digital data generated by the image reading unit 10. The RAM 73 may temporarily store a job and a job log.

The auxiliary storage device 120 is, for example, a hard disk or a solid state drive (SSD), and stores various data. The various data are, for example, the digital data, the job, and the job log.

The network interface 130 performs data transmission and reception with other devices. Here, the other devices include, for example, an information processing device such as a personal computer. The network interface 130 operates as an input interface, and receives data or instructions transmitted from other devices. The instructions transmitted from other devices include an instruction to execute printing and the like. The network interface 130 operates as an output interface, and transmits data to other devices.

Figure 4:
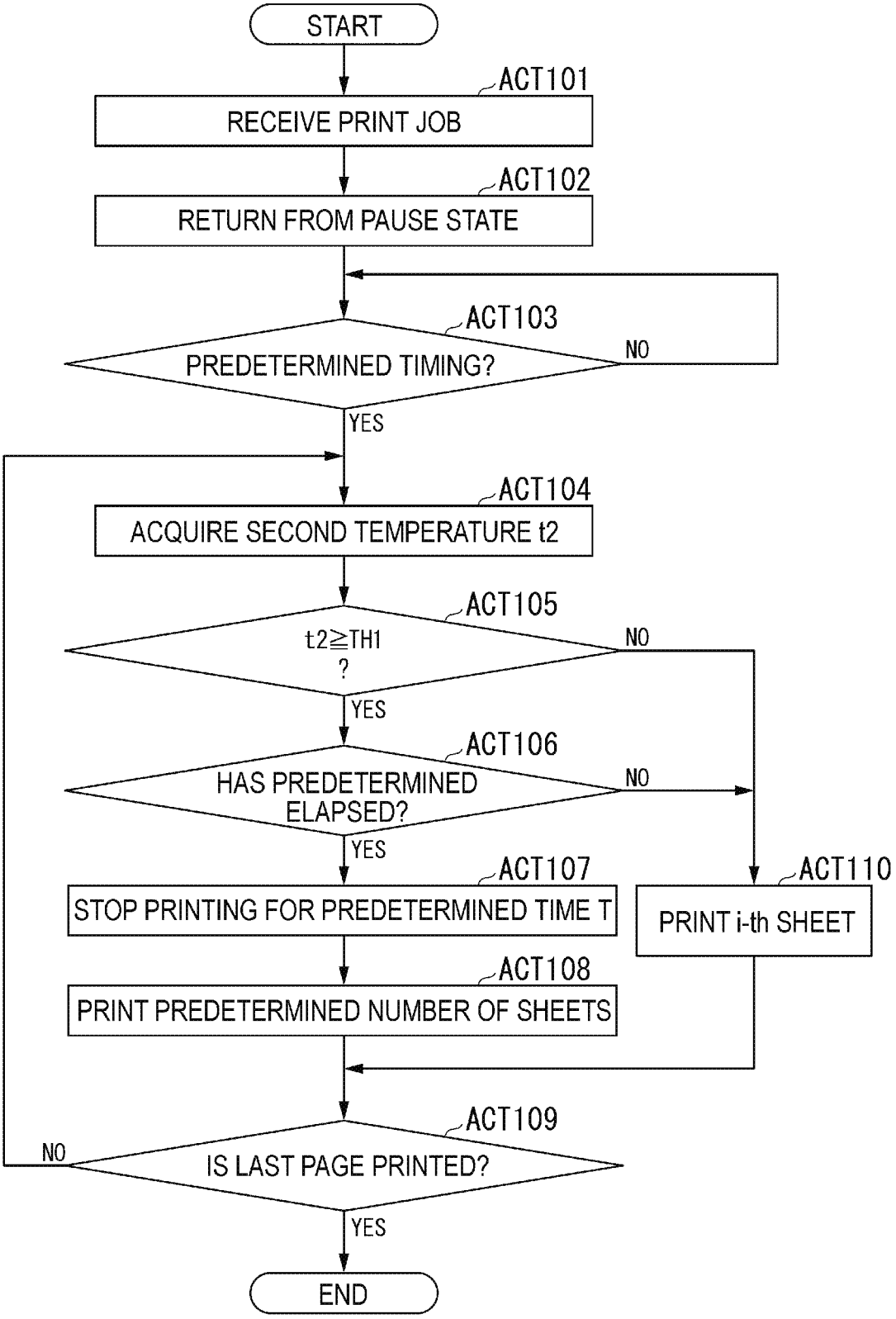
FIG. 4 is a flowchart depicting aspects of processing performed by an image forming apparatus.

FIG. 4 is a flowchart illustrating a flow of processing performed by the image forming apparatus 1 in an embodiment. When processing of FIG. 4 is started, the image forming apparatus 1 is in the pause state.

In the image forming apparatus 1, a print job is input directly or from the outside (ACT 101). For example, the image forming apparatus 1 receives the print job via the control panel 20, or receives the print job from an external apparatus via the network interface 130. The image forming apparatus 1 outputs the input print job to the control unit 71. When the print job is input, the control unit 71 causes the state of the image forming apparatus 1 to transition from the pause state (ACT 102). Specifically, the control unit 71 allows the image forming unit 30 to operate by restarting supply of power to the image forming unit 30, thereby causing the image forming unit 30 to transition from the pause state.

Figure 5:
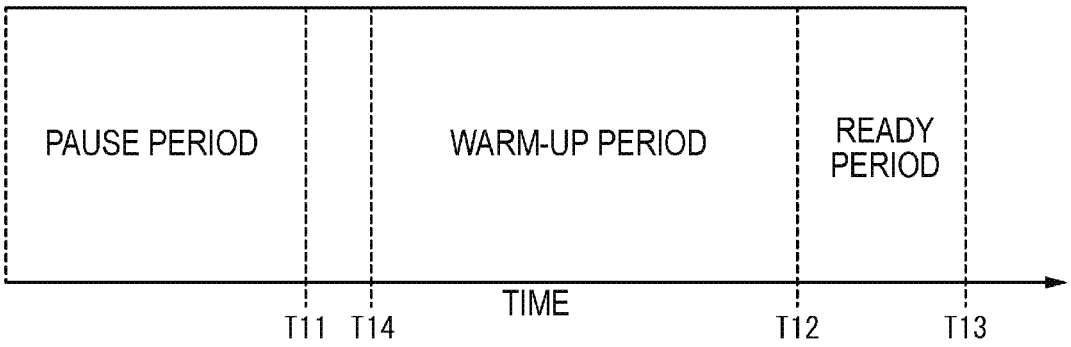
FIG. 5 is a timing chart illustrating aspects related to a return of an image forming apparatus from a pause state.

When the image forming apparatus 1 transitions from the pause state, as illustrated in FIG. 5, the image forming apparatus 1 transitions to the ready state through a warm-up period. The warm-up period is a preparation period for the image forming apparatus 1 to transition to the ready state. The warm-up period is, for example, 20 seconds to 30 seconds. When the image forming apparatus 1 transitions from the pause state, power is supplied to each functional unit and thus, the temperature inside the image forming apparatus 1 begins to rise. For that reason, heating by the anti-humidity heater 60 becomes unnecessary, and the anti-humidity heater 60 is stopped.

FIG. 5 is a timing chart for illustrating a state immediately after the image forming apparatus 1 according to the embodiment transitions from the pause state. As illustrated in FIG. 5, it is assumed that the image forming apparatus 1 operates in the pause state during a pause period, and begins a transition from the pause state at the point in time of time T11. Thereafter, a warm-up period corresponds to a period from time T11 to time T12, and a ready period corresponds to a period from time T12 to time T13. When the image forming apparatus 1 transitions from the pause state according to an instruction of print job, the printing operation is performed immediately after the warm-up period has ended. For that reason, when transitioning from the pause state by the instruction of print job, the ready period becomes approximately zero. On the other hand, when transitioning from the pause state by an instruction other than the instruction of print job, the ready period corresponds to a period from time T12 to time T13.

The image forming apparatus 1 in the embodiment determines whether or not a starting point timing ("Predetermined timing") has been reached after the image forming apparatus 1 transitions from the pause state ("Predetermined timing?"; ACT 103). That is, the control unit 71 determines whether or not any of the (1) to (4) starting point timings described above has been reached. It is assumed that which one of (1) to (4) starting point timings is to be used as a starting point has already been selected in advance.

The point in time when the image forming apparatus comes out of the pause state (described as starting point (1) above) would be the time T11 in FIG. 5. The point in time when heating by the anti-humidity heater 60 is stopped (illustrated as starting point (2)) would be, for example, time T14 in FIG. 5. The time at which heating by the anti-humidity heater 60 is stopped is the time at which the control unit 71 determines that heating by the anti-humidity heater 60 is to be stopped. The point in time when the image forming apparatus 1 enters the ready state (described as starting point (3)) is, for example, T12 in FIG. 5. The point in time when the image forming apparatus 1 starts the printing operation (described as starting point (4)) is, for example, time T13 in FIG. 5.

In FIG. 5, the times (1) to (4) are different from each other. However, in some scenarios some of the times (1) to (4) may be the same point in time. For example, the point in time when the image forming apparatus comes out of the pause state (start time (1)) and the point in time when heating by the anti-humidity heater 60 (start time (2)) can be the same time (that is, T11=T14). This situation is assumed to occur when heating by the anti-humidity heater 60 is stopped as soon as the image forming apparatus 1 comes out of the pause state. In some scenarios, the image forming apparatus 1 may begin printing operations (start time (4)) immediately after end of the warm-up period such that the start of the ready period (start time (3)) coincides with the start of printing operations (that is, T12=T13). As already mentioned above, this scenario is assumed to be a situation when the image forming apparatus 1 is transitioned from the pause state by an instruction of a print job.

The control unit 71 determines whether or not the selected one of the start times (1) to (4) has been reached after the transitioning from the pause state.

When it is determined that the start timing is not yet reached (NO in ACT 103), the control unit 71 waits until the start timing is reached.

On the other hand, when it is determined that the start timing has been reached (YES in ACT 103), the control unit 71 acquires the latest second temperature t2 from the RAM 73 (ACT 104). The control unit 71 compares the acquired second temperature t2 with a threshold TH, and determines whether or not the second temperature t2 is equal to or higher than the threshold TH (ACT 105). When it is determined that the second temperature t2 is equal to or higher than the threshold TH (YES in ACT 105), the control unit 71 determines whether or not the preset period (also referred to as a predetermined period") has elapsed after relevant start time was reached ("Has Predetermined [period] elapsed?"; ACT 106).

When it is determined that preset period has elapsed (YES in ACT 106), the control unit 71 stops the printing by the image forming process and the image fixing process for a predetermined time T (ACT 107). Specifically, the control unit 71 stops image formation by the image forming unit 30, image fixing by the fixing device 50, and conveyance of the sheet by the conveyance unit 80 for the predetermined time T. Here, the control unit 71 does not necessarily stop supply of power to the rollers included in the image forming unit 30, the fixing device 50, and the conveyance unit 80, but does control the rollers to stop operating. With this configuration, printing by the image forming apparatus 1 is not performed for the predetermined time T.

Once the predetermined time T has elapsed, the control unit 71 restarts printing by the image forming process and the image fixing process to execute printing of a predetermined number of sheets (ACT 108). Specifically, the control unit 71 operates the rollers included in the image forming unit 30, the fixing device 50, and the conveyance unit 80 to restart printing. The control unit 71 acquires the measurement result from the first temperature sensor 75 periodically or other timing. The control unit 71 acquires the measurement result from the second temperature sensor 36 periodically or other timing. However, the control unit 71 does not stop printing even if the temperature exceeds the threshold until printing of a predetermined number of sheets has completed.

The control unit 71 determines whether or not printing of the last page of image information in the print job has ended (ACT 109). When it is determined that printing of the last page of the image information in the print job has ended (YES in ACT 109), the image forming apparatus 1 ends the process.

On the other hand, when it is determined that printing of the last page of the image information in the print job has not ended (NO in ACT 109), the image forming apparatus 1 repeatedly executes the process after ACT 104.

When it is determined that the second temperature t2 is less than the threshold TH in processing of ACT 105 (NO in ACT 105), the control unit 71 executes printing of an i-th (where i is an integer of 1 or more) sheet (ACT 110). Specifically, the control unit 71 controls the image forming unit 30 and the fixing device 50 to execute printing of the i-th sheet. The control unit 71 updates a value of 1 by adding 1 to the value of i each time printing is performed. Thereafter, the image forming apparatus 1 executes processing of ACT 109.

When it is determined that the preset period has not elapsed in the processing of ACT 106 (NO in ACT 106), the control unit 71 causes the i-th sheet to be printed (ACT 110). As described above, the control unit 71 continues the printing operation so long as the preset period has not elapsed even if the second temperature t2 is equal to or higher than the threshold.

According to the image forming apparatus 1 configured as described above, it is possible to prevent a decrease in print performance (for example, the number of sheets subjected to image formation per unit time). The image forming apparatus 1 executes image formation regardless of the second temperature t2 until the preset period elapses from some point in time after the start of a transitioning from the pause state. With this configuration, even if the heat generated by the anti-humidity heater 60 affects detection of the temperature near the image forming unit 30, the image forming operation is not interrupted. Accordingly, the printing operation can be continued until preset period elapses. Thus, it is possible to prevent the decrease in performance.

Some functions of the image forming apparatus 1 described above may be performed by a computer. In this case, a program for performing the functions is recorded on a non-volatile computer readable recording medium. Then, the program may be performed by causing a computer system to read and execute the program recorded in a recording medium in which the program described above is recorded. Here, the "computer system" includes hardware and peripheral devices and an operating system or the like. Also, the "computer readable recording medium" means a portable medium, a storage device, and the like. The portable medium is a flexible disk, a magneto-optical disk, a ROM, a CD-ROM or the like. The storage device is a hard disk or the like embedded in a computer system. Furthermore, a "computer readable recording medium" can include an element that holds a program for a short time. The "computer readable recording medium" can be provide across a network such as the Internet or a telephone line. The "computer readable recording medium" may a cloud-based or other distributed system or server. Various functions described above for an embodiment can be provided by software in combination with hardware or by dedicated hardware and/or circuitry. When functions are provided by software, the software may be a dedicated program and/or a software program running combination with other software programs (such as an operating system or the like).

While certain embodiments have been described these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

an image forming unit;

a first temperature sensor configured to measure a temperature of the image forming unit; and a controller configured to:

control an operational state of the image forming apparatus to be in a print ready state or a print unready state in which power consumption of the image forming apparatus is less than power consumption of the image forming apparatus in the print ready state;

for a preset period after a time at which the image forming apparatus transitions out of the print unready state, disable a print suspend operation which is carried out when the temperature detected by the first temperature sensor is a threshold value or higher; and after the preset period, enable the print suspend operation.

2. The image forming apparatus according to claim 1, wherein the preset period is a fixed period of time.

3. The image forming apparatus according to claim 1, wherein the preset period is calculated as a fixed number of sheets being printed by the image forming apparatus.

4. The image forming apparatus according to claim 1, further comprising:

a heater configured to heat the image forming unit, wherein the time at which the image forming apparatus transitions out of the print unready state is a time at which the heater switches off.

5. The image forming apparatus according to claim 1, wherein the controller is configured to perform a warmup operation in the transitioning from the print unready state to the print ready state.

6. The image forming apparatus according to claim 1, wherein the temperature sensor is a thermistor in the image forming unit.

7. The image forming apparatus according to claim 1, wherein the controller is configured to enable printing of a predetermined number of sheets after a print suspend operation ends after a predetermined suspension time even if the temperature detected by the first temperature sensor is the threshold value or higher.

8. The image forming apparatus according to claim 1, further comprising:

a second temperature sensor configured to measure an ambient temperature of the image forming apparatus; and a heater configured to heat the image forming unit, wherein the controller is further configured to control the heater such that the temperature detected by the first temperature sensor is in a first predetermined temperature range while in the print unready state when the ambient temperature is in a second predetermined temperature range.

9. A method for controlling an image forming apparatus including an image forming unit and a first temperature sensor configured to measure a temperature of the image forming unit, the method comprising:

controlling an operational state of the image forming apparatus to transition out of a print unready state and into a print ready state, power consumption of the image forming apparatus in the print unready state being less than power consumption of the image forming apparatus in the print ready state;

for a preset period after a time at which the image forming apparatus transitions out of the print unready state, disabling a print suspend operation which is carried out when the temperature detected by the first temperature sensor is a threshold value or higher; and after the preset period, enabling the print suspend operation.

10. The method according to claim 9, wherein the preset period is a fixed period of time.

11. The method according to claim 9, wherein the preset period is calculated as a fixed number of sheets being printed by the image forming apparatus.

12. The method according to claim 9, wherein the image forming apparatus further includes a heater configured to heat the image forming unit, and the time at which the image forming apparatus transitions out of the print unready state is a time at which the heater switches off.

13. The method according to claim 9, wherein the time at which the image forming apparatus transitions out of the print unready state coincides with a start of a printing of a sheet by the image forming unit.

14. The method according to claim 9, wherein the print unready state includes a warmup period and the time at which the image forming apparatus transitions out of the print unready state coincides with an end of the warmup period.

15. The method according to claim 9, wherein the print suspend operation suspends printing for a fixed time period.

16. The method according to claim 9, further comprising:

performing the print suspend operation in response to the temperature detected by the first temperature sensor being at or above the threshold value and suspending printing operations for a fixed time period; and after the fixed timer period, enabling printing of up to a predetermined number of pages even when the temperature detected by the first temperature sensor is at or above the threshold value.

17. The method according to claim 9, wherein the image forming apparatus further includes a second temperature sensor configured to measure an ambient temperature of the image forming apparatus and a heater configured to heat the image forming unit, and the method further comprises:

controlling the heater such that the temperature detected by the first temperature sensor is in a first predetermined temperature range during the print unready state when the ambient temperature is in a second predetermined temperature range.

18. The method according to claim 9, wherein the operational state of the image forming apparatus transitions out of the print unready state into the print ready state via a warming up state in which the image forming unit starts operating while printing by the image forming unit is disabled.

19. An image forming apparatus, comprising:

an image forming unit configured to form an image on a sheet;

a temperature measurement unit configured to measure a temperature of the image forming unit; and a control unit configured to cause the image forming unit to execute formation of an image even if the temperature of the image forming unit is a threshold value of higher during a preset period after returning from a power saving state and otherwise after said preset period cause the image forming unit to suspend formation of an image if the temperature of the image forming unit is the threshold value or higher.

20. The image forming apparatus according to claim 19, wherein the preset period begins when the power saving state ends.

* * * * *